US011135846B2

(12) United States Patent
Budraa

(10) Patent No.: US 11,135,846 B2
(45) Date of Patent: Oct. 5, 2021

(54) NOZZLE GEOMETRY FOR PRINTHEADS

(71) Applicant: Nasser Budraa, La Crescenta, CA (US)

(72) Inventor: Nasser Budraa, La Crescenta, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/999,301

(22) Filed: Aug. 21, 2020

(65) Prior Publication Data

US 2020/0376841 A1 Dec. 3, 2020

Related U.S. Application Data

(63) Continuation of application No. 16/353,844, filed on Mar. 14, 2019, now Pat. No. 10,773,522.

(51) Int. Cl.
*B41J 2/14* (2006.01)
*B41J 2/145* (2006.01)

(52) U.S. Cl.
CPC ..... *B41J 2/1433* (2013.01); *B41J 2/145* (2013.01); *B41J 2/14274* (2013.01); *B41J 2002/14475* (2013.01)

(58) Field of Classification Search
CPC ..... B41J 2/1433; B41J 2/14274; B41J 2/145; B41J 2002/14475
See application file for complete search history.

(56) References Cited

U.S. PATENT DOCUMENTS 8,888,244 B2 * 11/2014 Kang ..... B41J 2/1629 347/47
2014/0160203 A1 * 6/2014 Kang ..... B41J 2/1628 347/47

* cited by examiner

*Primary Examiner* — Geoffrey S Mruk
(74) *Attorney, Agent, or Firm* — Duft & Bornsen, PC

(57) ABSTRACT

Printheads for a jetting apparatus. In one embodiment, a printhead comprises a plurality of nozzles configured to eject a print fluid. Each nozzle is comprised of a first converging section having a cross-sectional area that decreases in a flow direction of the print fluid through the nozzle, a neck adjoining the first converging section and having a cross-sectional area that is uniform in the flow direction of the print fluid through the nozzle, and a second converging section adjoining the neck and having a cross-sectional area that decreases in the flow direction of the print fluid through the nozzle.

20 Claims, 7 Drawing Sheets

NOZZLE GEOMETRY FOR PRINTHEADS

RELATED APPLICATIONS

This non-provisional patent application is a continuation of U.S. Pat. No. 10,773,522 filed on Mar. 14, 2019, which is incorporated herein by reference.

TECHNICAL FIELD

The following disclosure relates to the field of printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and a mechanism for ejecting the print fluid from the pressure chamber and through the nozzle, which is typically a diaphragm that is driven by an actuator (e.g., a piezoelectric actuator). A printhead also includes a drive circuit that controls when each individual jetting channel fires based on image data. To jet from a jetting channel, the drive circuit provides a jetting pulse to the actuator, which causes the actuator to deform a wall of the pressure chamber via the diaphragm. The deformation of the pressure chamber creates pressure waves within the pressure chamber that eject a droplet of print fluid (e.g., ink) out of the nozzle. A drop emerging from the nozzle will extrude as a jet which necks down and breaks off from the print fluid remaining in the nozzle. In an ideal case, the jet will move towards the medium with surface tension forces pulling the liquid into a spherical droplet. The surface tension will also cause the print fluid still attached to the nozzle to be drawn back into the nozzle. After the initial break-off, the jet has a head containing most of the print fluid, and a ligament or tail that extends from the head. When detached, the ligament will start to merge into the head of the jet. Depending on the viscosity of the print fluid, jetting velocity, and other jetting characteristics, the ligament may not merge into the head before it reached the medium, which results in satellites that are undesirable.

SUMMARY

Embodiments described herein comprise improved nozzle geometries or shapes for printheads. The nozzle shape creates an instability in the print fluid as it passes through the nozzle, which reduces the length of a ligament for a jet. In one embodiment, nozzles as described herein may have a shape that converges for a portion of the length of the nozzle, stays uniform for the next portion of the length, and then converges again. This shape causes the velocity of the print fluid to increase initially in the nozzle, to remain constant along a partial length of the nozzle, and then to increase again before being ejected out of the nozzle. In another embodiment, the nozzles may have a shape that converges for a portion of the length of the nozzle, and then converges again for the remaining portion of the length. These nozzle shapes act to create instability in the jet that is discharged from the nozzle. It is one effective means for interacting with the print fluid closest to its exit point from the printhead. As such, the nozzle acts as a way to affect the shape of the jet in a manner that is closest to the desired output. In the case of high viscosity print fluids, droplet formation is hampered by the viscosity and the surface tension of the print fluid being jetted. In jetting these types of print fluids, the jet becomes exceedingly long as the viscous forces dominate over inertial forces. A break-off of the jet from the rest of the print fluid in the nozzle occurs late and at a long distance from the orifice. Thus, the ligament of the jet may become exceedingly long, and does not merge into the head of the jet. The shape of the nozzles described herein creates a difference in speed of the print fluid, and causes an artificial instability within the jet. This instability accelerates the break-off time, and reduces the length of the ligament to form a more desirable droplet.

In one embodiment, a printhead includes a plurality of nozzles configured to eject a print fluid. Each nozzle is comprised of a first converging section having a cross-sectional area that decreases in a flow direction of the print fluid through the nozzle, a neck adjoining the first converging section and having a cross-sectional area that is uniform in the flow direction of the print fluid through the nozzle, and a second converging section adjoining the neck and having a cross-sectional area that decreases in the flow direction of the print fluid through the nozzle.

In another embodiment, the cross-sectional area of the second converging section at an end adjoining the neck is equivalent to the cross-sectional area of the neck.

In another embodiment, the cross-sectional area of the second converging section at an end adjoining the neck is greater than a cross-sectional area of the neck.

In another embodiment, a first convergence angle of the first converging section is equivalent to a second convergence angle of the second converging section.

In another embodiment, a first convergence angle of the first converging section is greater than a second convergence angle of the second converging section.

In another embodiment, a first convergence angle of the first converging section is less than a second convergence angle of the second converging section.

In another embodiment, the printhead further includes a housing and a plate stack attached to the housing. A single nozzle plate in the plate stack defines the nozzle.

In another embodiment, the printhead further includes a housing and a plate stack attached to the housing. A first nozzle plate and a second nozzle plate in the plate stack define the nozzle. The first nozzle plate defines the first converging section and the neck, and the second nozzle plate defines the second converging section.

In another embodiment, the printhead further includes a housing and a plate stack attached to the housing. A first nozzle plate, a second nozzle plate, and a third nozzle plate in the plate stack define the nozzle. The first nozzle plate defines the first converging section, the second nozzle plate defines the neck, and the third nozzle plate defines the second converging section.

Another embodiment comprises a printhead that includes a plurality of nozzles configured to eject a print fluid. Each nozzle is comprised of a first converging section having a cross-sectional area that decreases in a flow direction of the print fluid through the nozzle, and a second converging section adjoining the first converging section, and having a cross-sectional area that decreases in the flow direction of the print fluid through the nozzle.

In another embodiment, a first convergence angle of the first converging section is greater than a second convergence angle of the second converging section.

In another embodiment, a first convergence angle of the first converging section is less than a second convergence angle of the second converging section.

In another embodiment, the printhead further includes a housing and a plate stack attached to the housing. A single nozzle plate in the plate stack defines the nozzle.

In another embodiment, the printhead further includes a housing and a plate stack attached to the housing. A first nozzle plate and a second nozzle plate in the plate stack define the nozzle. The first nozzle plate defines the first converging section, and the second nozzle plate defines the second converging section.

Another embodiment comprises a printhead that includes a plurality of nozzles configured to eject a print fluid. Each nozzle of the plurality is comprised of a first converging section having a diameter that decreases in a flow direction of the print fluid through the nozzle, and a second converging section having a diameter that decreases in the flow direction of the print fluid through the nozzle.

In another embodiment, the first converging section has a cone shape that tapers at a first convergence angle, and the second converging section has a cone shape that tapers at a second convergence angle that is less than the first convergence angle.

In another embodiment, the first converging section has a cone shape that tapers at a first convergence angle, and the second converging section has a cone shape that tapers at a second convergence angle that is greater than the first convergence angle.

In another embodiment, the nozzle is further comprised of a neck between the first converging section and the second converging section. The neck has a diameter that is uniform in the flow direction of the print fluid through the nozzle.

In another embodiment, the diameter of the second converging section at an end adjoining the neck is equivalent to the diameter of the neck.

In another embodiment, the diameter of the second converging section at an end adjoining the neck is greater than the diameter of the neck.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
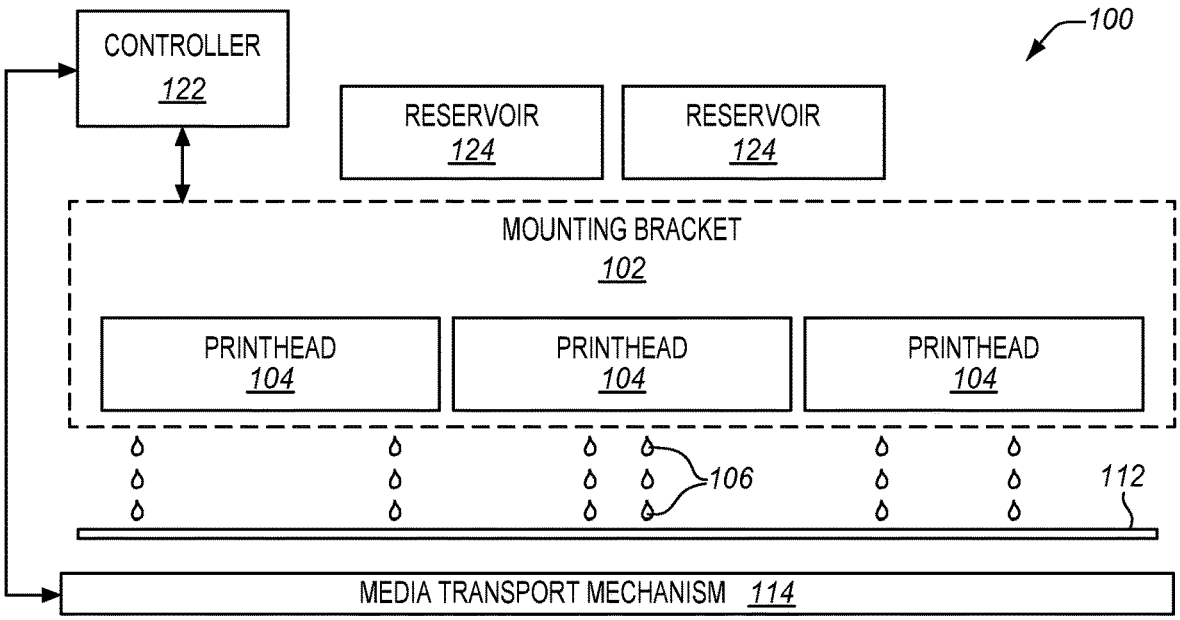
FIG. 1 is a schematic diagram of a jetting apparatus in an illustrative embodiment.

FIG. 1 is a schematic diagram of a jetting apparatus 100 in an illustrative embodiment. One example of jetting apparatus 100 is an inkjet printer that performs single-pass or multi-pass printing. Jetting apparatus 100 includes a mounting bracket 102 that supports one or more printheads 104 above a medium 112. Mounting bracket 102 may be disposed on a carriage assembly that reciprocates back and forth along a scan line or sub-scan direction for multi-pass printing. Alternatively, mounting bracket 102 may be fixed within jetting apparatus 100 for single-pass printing. Printheads 104 are a device, apparatus, or component configured to eject droplets 106 of a print fluid, such as ink (e.g., water, solvent, oil, or UV-curable), through a plurality of orifices or nozzles (not visible in FIG. 1). The droplets 106 ejected from the nozzles of printheads 104 are directed toward medium 112. Medium 112 comprises any type of material upon which ink or another print fluid is applied by a printhead, such as paper, plastic, card stock, transparent sheets, a substrate for 3D printing, cloth, etc. Typically, nozzles of printheads 104 are arranged in one or more rows so that ejection of print fluid from the nozzles causes formation of characters, symbols, images, layers of an object, etc., on medium 112 as printhead 104 and/or medium 112 are moved relative to one another. Media transport mechanism 114 is configured to move medium 112 relative to printheads 104. Jetting apparatus 100 also includes a jetting apparatus controller 122 that controls the overall operation of jetting apparatus 100. Jetting apparatus controller 122 may connect to a data source to receive image data, and control each printhead 104 to discharge the print fluid on a desired pixel grid on medium 112. Jetting apparatus 100 also includes one or more reservoirs 124 for a print fluid. Although not shown in FIG. 1, reservoirs 124 may be connected to printheads 104 via hoses or the like.

Figure 2:
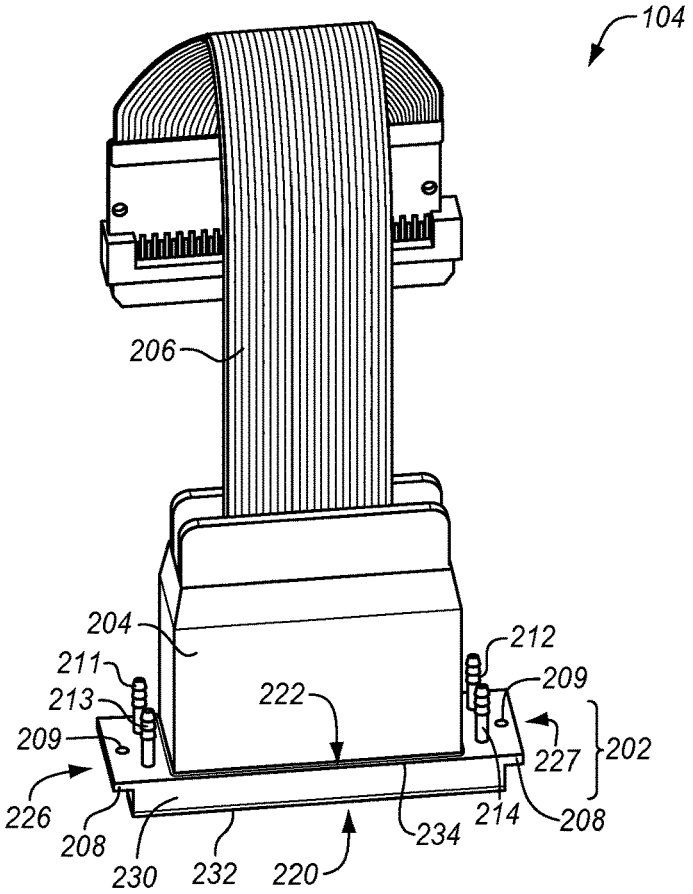
FIG. 2 is a perspective view of a printhead in an illustrative embodiment.

FIG. 2 is a perspective view of a printhead 104 in an illustrative embodiment. Printhead 104 includes a head member 202 and electronics 204. Head member 202 is an elongated component that forms the jetting channels of printhead 104. A typical jetting channel includes a nozzle, a pressure chamber, and a mechanism for ejecting the print fluid from the pressure chamber and through the nozzle, which is typically a diaphragm that is driven by an actuator (e.g., a piezoelectric actuator). Electronics 204 control how the nozzles of printhead 104 jet droplets in response to control signals. Although not visible in FIG. 2, electronics 204 may include a plurality of actuators (e.g., piezoelectric actuators) that contact the diaphragms of the jetting channels. Electronics 204 also include cabling 206, such as a ribbon cable, that connects to a controller (e.g., jetting apparatus controller 122) to receive the control signals. Printhead 104 also includes attachment members 208, which are configured to secure printhead 104 to a jetting apparatus, such as to mounting bracket 102 as illustrated in FIG. 1. Attachment members 208 may include one or more holes 209 so that printhead 104 may be mounted within a jetting apparatus by screws, bolts, pins, etc.

The bottom surface 220 of head member 202 includes the nozzles of the jetting channels, and represents the discharge surface of printhead 104. The top surface 222 of head member 202 represents the Input/Output (I/O) portion for receiving print fluids into printhead 104 and/or conveying print fluids (e.g., fluids that are not jetted) out of printhead 104, such as with the case of a flow-through printhead. Top surface 222, which is also referred to as the I/O surface, includes a plurality of I/O ports 211-214. Top surface 222 has two ends 226-227 that are separated by electronics 204. I/O ports 211/213 are disposed toward end 226, and I/O ports 212/214 are disposed toward end 227. I/O ports 211-214 may include a hose coupling, hose barb, etc., for coupling with a supply hose of a reservoir 124, a cartridge, or the like.

Head member 202 includes a housing 230 and a plate stack 232. Housing 230 is a rigid member made from stainless steel or another type of material. Housing 230 includes an access hole 234 that provides a passageway for electronics 204 to pass through housing 230 so that actuators may interface with diaphragms of the jetting channels. Plate stack 232 attaches to an interface surface (not visible) of housing 230. Plate stack 232 (also referred to as a laminate plate stack) is a series of plates that are fixed or bonded to one another to form a laminated stack.

Figure 3:
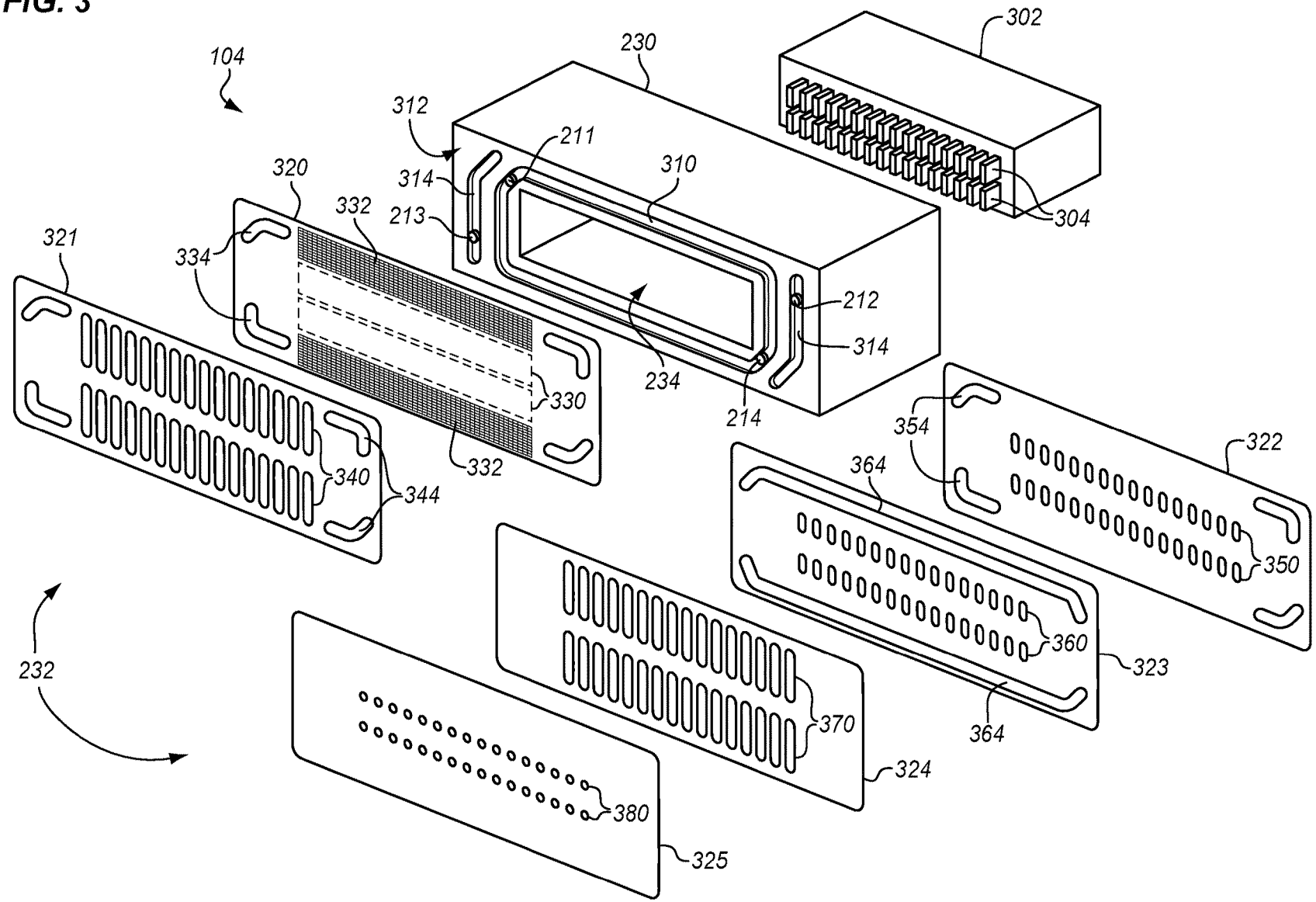
FIG. 3 is an exploded, perspective view of a printhead in an illustrative embodiment.

FIG. 3 is an exploded, perspective view of printhead 104 in an illustrative embodiment. Printhead 104 is a flow-through type of printhead in this embodiment, but non-flow-through types of printheads are considered herein. In this embodiment, printhead 104 includes piezoelectric device 302, housing 230, and plate stack 232. Piezoelectric device 302 includes a plurality of piezoelectric actuators 304 or piezoelectric elements; one for each of the jetting channels. The ends of piezoelectric actuators 304 contact diaphragms at positions opposite the pressure chambers.

Housing 230 includes a groove 310 on interface surface 312 facing plate stack 232 that encompasses or substantially surrounds access hole 234. Groove 310 forms a supply manifold for printhead 104 that is configured to supply a print fluid to the jetting channels. I/O ports 211 and 214 are fluidly coupled to groove 310. Housing 230 further includes one or more grooves 314 on interface surface 312 that are separate or isolated from groove 310. Grooves 314 form a return manifold for printhead 104 that is configured to receive print fluid that flows through the jetting channels and is not ejected from the nozzles. I/O ports 212 and 213 are fluidly coupled to grooves 314.

Plate stack 232 includes plates 320-325 that are fixed or bonded to one another to form a laminated plate structure. Plate stack 232 illustrated in FIG. 3 is intended to be an example of a basic structure of a printhead. There may be additional plates that are used in the plate stack 232 that are not shown in FIG. 3, and the configuration of the various plates may vary as desired. Also, FIG. 3 is not drawn to scale.

In this embodiment, plate stack 232 includes the following plates: a diaphragm plate 320, an upper restrictor plate 321, chamber plates 322-323, a lower restrictor plate 324, and an orifice or nozzle plate 325. Diaphragm plate 320 is a thin sheet of material (e.g., metal, plastic, etc.) that is generally rectangular in shape and is substantially flat or planar. Diaphragm plate 320 includes diaphragm sections 330 comprising a sheet of a semi-flexible material that forms diaphragms for the jetting channels. Diaphragm sections 330 are disposed longitudinally to correspond with the pressure chambers. Diaphragm plate 320 further includes filter sections 332 that are disposed longitudinally on opposing sides of diaphragm sections 330 to coincide with the supply manifold. Filter sections 332 are configured to remove foreign matter from print fluid flowing in the jetting channels from the supply manifold. Although diaphragm plate 320 is shown as including both diaphragm sections 330 and filter sections 332 in this embodiment, diaphragm sections 330 and filter sections 332 may be implemented in separate plates in other embodiments. Diaphragm plate 320 also includes return openings 334 that are part of the return manifold for printhead 104. The return openings 334 are positioned to coincide with at least a portion of groove 314 of housing 230.

Upper restrictor plate 321 is a thin sheet of material that is generally rectangular in shape and is substantially flat or planar. Upper restrictor plate 321 includes restrictor openings 340. Restrictor openings 340 comprise elongated apertures or holes through upper restrictor plate 321 transversely disposed or oriented. Restrictor openings 340 are configured to fluidly couple pressure chambers of the jetting channels with the supply manifold. Upper restrictor plate 321 also includes return openings 344 disposed toward ends of upper restrictor plate 321 to coincide with return openings 334 of diaphragm plate 320.

Chamber plate 322 is a thin sheet of material that is generally rectangular in shape and is substantially flat or planar. Chamber plate 322 includes chamber openings 350 disposed toward a middle region of chamber plate 322. Chamber openings 350 comprise apertures or holes through chamber plate 322 that form pressure chambers for the jetting channels. Chamber plate 322 also includes return openings 354 disposed toward ends of chamber plate 322 to coincide with return openings 344 of upper restrictor plate 321.

Chamber plate 323 is a thin sheet of material that is generally rectangular in shape and is substantially flat or planar. Chamber plate 323 includes chamber openings 360 disposed toward a middle region of chamber plate 323. Chamber openings 360 coincide with chamber openings 350 of chamber plate 322 to form the pressure chambers for the jetting channels. Chamber plate 323 also includes return openings 364, which comprise elongated apertures or holes through chamber plate 323 disposed longitudinally along a length of chamber plate 323. Return openings 364 are disposed toward the long sides of chamber plate 323 on opposing sides of chamber openings 360 to form the return manifold. At least a portion of return openings 364 coincide with return openings 354 of chamber plate 322.

Lower restrictor plate 324 is a thin sheet of material that is generally rectangular in shape and is substantially flat or planar. Lower restrictor plate 324 includes restrictor openings 370, which comprise elongated apertures or holes through lower restrictor plate 324 transversely disposed or oriented. Restrictor openings 370 are configured to fluidly couple pressure chambers of the jetting channels with the return manifold.

Nozzle plate 325 is a thin sheet of material that is generally rectangular in shape and is substantially flat or planar. Nozzle plate 325 includes orifices that form nozzles 380 of the jetting channels. Each nozzle 380 represents an individual jetting channel in printhead 104 for ejecting a print fluid. In this embodiment, nozzles 380 are arranged in two nozzle rows. However, nozzles 380 may be arranged in a single row or in more than two rows in other embodiments.

Figure 4:
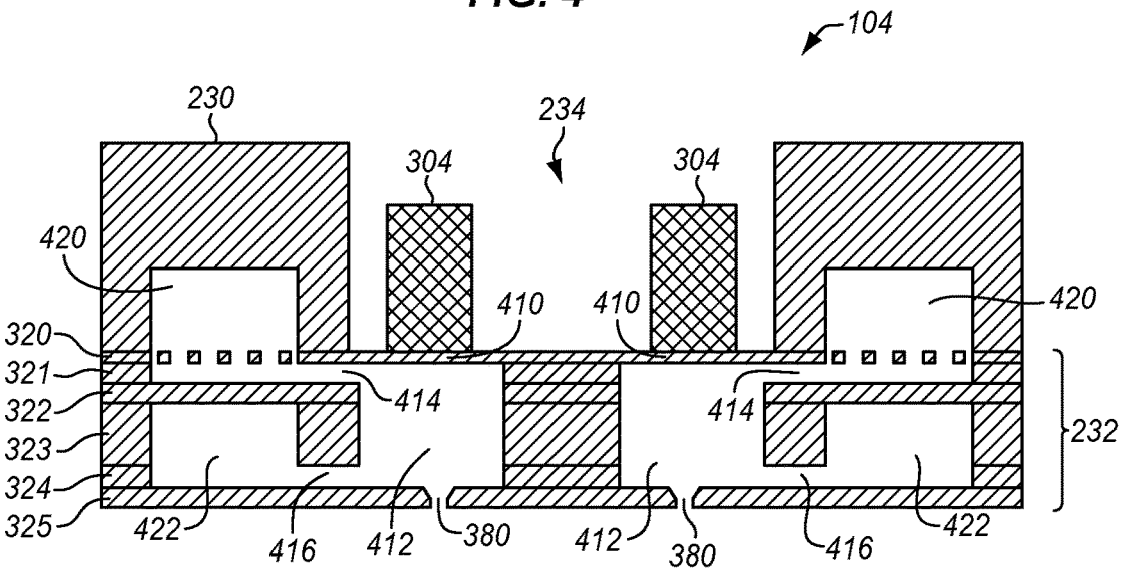
FIG. 4 is a cross-sectional view of jetting channels in a printhead in an illustrative embodiment.

FIG. 4 is a cross-sectional view of jetting channels in printhead 104 in an illustrative embodiment. The view in FIG. 4 is as if a slice were taken transversely through printhead 104. From top to bottom in FIG. 4, printhead 104 includes housing 230, diaphragm plate 320, upper restrictor plate 321, chamber plates 322-323, lower restrictor plate 324, and nozzle plate 325. A jetting channel includes diaphragm 410, pressure chamber 412, and nozzle 380. Pressure chamber 412 is fluidly coupled to a supply manifold 420 via an upper restrictor 414. Upper restrictor 414 controls the flow of print fluid from the supply manifold 420 to pressure chamber 412. Pressure chamber 412 is also fluidly coupled to a return manifold 422 via a lower restrictor 416. Lower restrictor 416 controls the flow of print fluid from pressure chamber 412 to return manifold 422. Actuation by a piezoelectric actuator 304 will cause the print fluid to be ejected out of the jetting channel through nozzle 380.

Although a piezoelectric printhead 104 is illustrated in FIGS. 3-4, other types of printheads 104 may be used in jetting apparatus 100, such as a thermal printhead.

Figure 5:
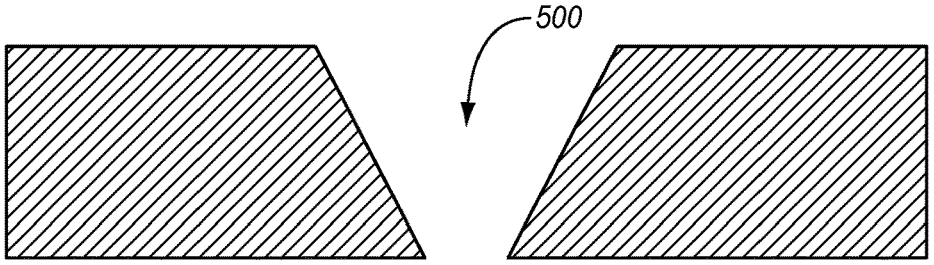
FIGS. 5-6 are cross-sectional views of a traditional nozzle of a printhead.
Figure 6:
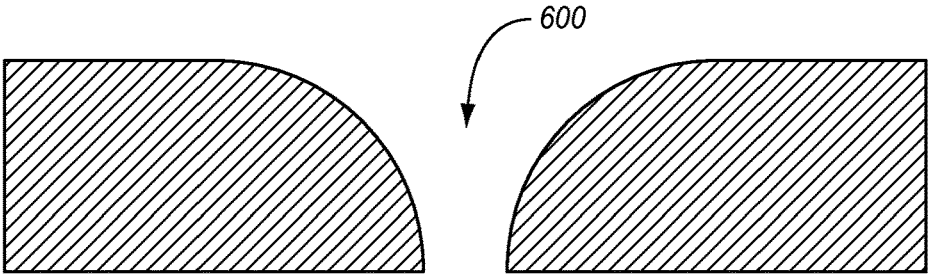

FIGS. 5-6 are cross-sectional views of a traditional nozzle of a printhead. Nozzle 500 in FIG. 5 is a cone-shaped nozzle, and nozzle 600 in FIG. 6 is a bell-shaped nozzle. Nozzles 500-600 are both convergent nozzles where the cross-sectional area decreases. As a print fluid enters the smaller cross-section, it increases in velocity due to the conservation of mass. Although these nozzle shapes may be effective for their intended purpose, other nozzle shapes may provide different or better jetting characteristics.

Figure 7:
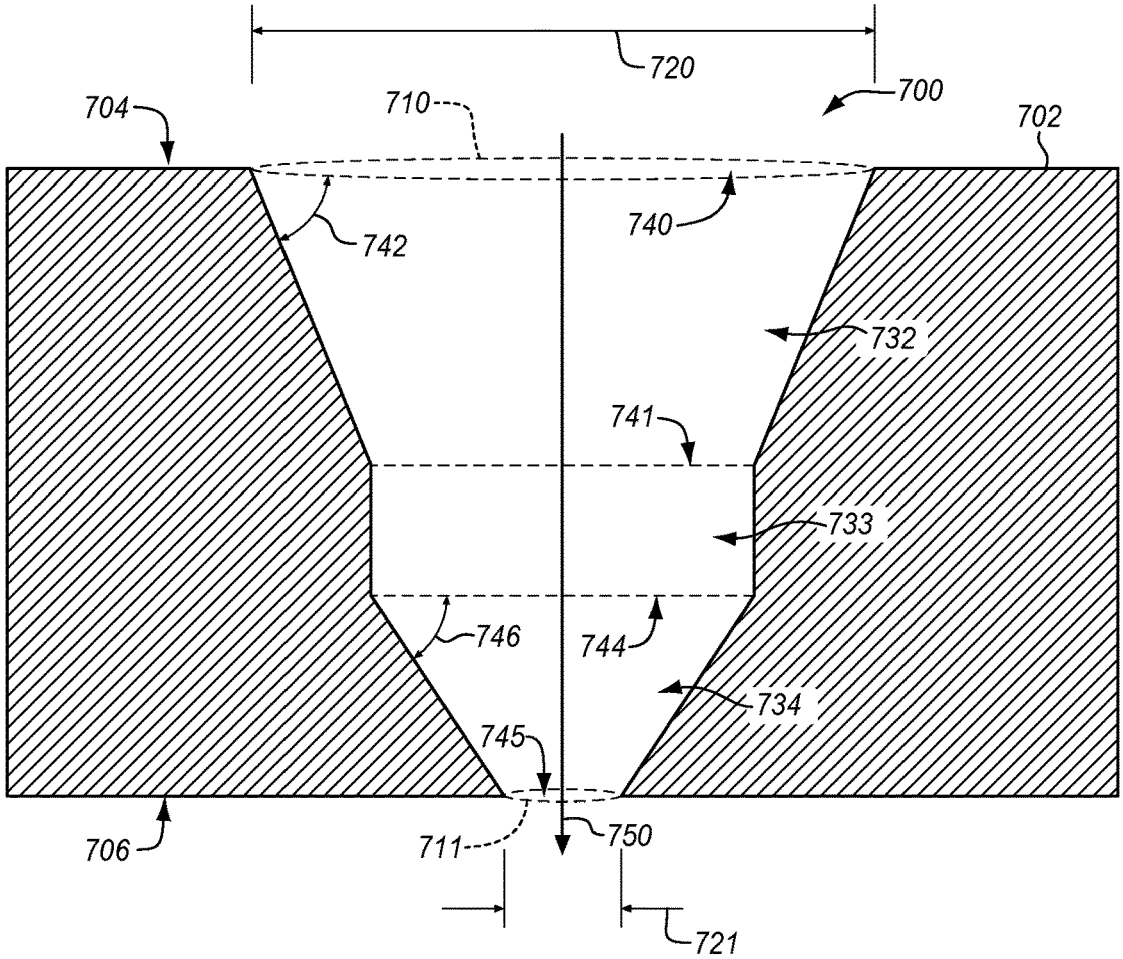
FIG. 7 is a cross-sectional view of a nozzle of a printhead in an illustrative embodiment.

FIG. 7 is a cross-sectional view of a nozzle 700 of a printhead in an illustrative embodiment. Nozzle 700 may be an example of a nozzle 380 described above for printhead 104. Nozzle 700 comprises an aperture or opening through one or more nozzle plates 702. Nozzle plate(s) 702 in FIG. 7 may be an example of nozzle plate 325 shown in FIG. 3. Nozzle plate 702 includes an interface surface 704 and a discharge surface 706. Interface surface 704 represents a surface that abuts another plate in a plate stack, such as a lower restrictor plate 324 in FIG. 3. Discharge surface 706 represents the surface from which a droplet of print fluid is ejected or jetted from a printhead. One end of nozzle 700 is toward a higher-pressure region within a printhead (e.g., a pressure chamber), and is the entrance 710 for a print fluid into nozzle 700. The other end of nozzle 700 is toward a lower-pressure region outside of the printhead (e.g., ambient air), and is the exit 711 for the print fluid out of nozzle 700. Exit 711 may also be referred to as the orifice. Entrance 710 has a diameter 720 that is larger than a diameter 721 of exit 711.

From entrance 710 to exit 711 along its length, nozzle 700 is comprised of a first converging section 732, a neck 733 that abuts or adjoins first converging section 732, and a second converging section 734 that abuts or adjoins neck 733. First converging section 732 has a cross-sectional area (taken transverse or width-wise, which is into the page in FIG. 7) that decreases in the flow direction of print fluid through nozzle 700, which is indicated by arrow 750. First converging section 732 has a cone shape that tapers or angles from end 740 to end 741 so that the diameter of first converging section 732 decreases from end 740 to end 741. Neck 733 has a cross-sectional area that is generally constant, uniform, or otherwise continuous in the flow direction of print fluid through nozzle 700. The diameter of neck 733 may correspond with the diameter of first converging section 732 at end 741, and remains uniform along a length of neck 733 in the flow direction (e.g., arrow 750). Second converging section 734 has a cross-sectional area that decreases in the flow direction of print fluid through nozzle 700. Second converging section 734 has a cone shape that tapers or angles from end 744 to end 745 so that the diameter of second converging section 734 decreases from end 744 to end 745 (i.e., exit 711). In this embodiment, the diameter (or cross-sectional area) of second converging section 734 at end 744 is generally the same as or equivalent to the diameter (or cross-sectional area) of neck 733. The diameter 721 of second converging section 734 at end 745 is less than the diameter of neck 733 and first converging section 732 at end 741.

A head designer may adjust the convergence angle 742 of first converging section 732, the convergence angle 746 of second converging section 734, and/or the diameter of neck 733 based on the desired jetting characteristics. In one embodiment, the convergence angles 742/746 may be the same or equivalent. In another embodiment, the convergence angle 742 of first converging section 732 may be greater than the convergence angle 746 of second converging section 734. In another embodiment, the convergence angle 746 of second converging section 734 may be greater than the convergence angle 742 of first converging section 732.

As a print fluid travels through first converging section 732, the velocity of the print fluid increases due to the converging shape of first converging section 732 (i.e., conservation of mass). As the print fluid travels through neck 733, the velocity of the print fluid stays constant due to the uniform diameter of neck 733. As a print fluid travels through second converging section 734, the velocity of the print fluid again increases due to the converging shape of second converging section 734. The difference in velocity of the print fluid in the different sections of nozzle 700 affects the viscous forces of the print fluid in nozzle 700, and creates an instability in the jet discharged from nozzle 700. This instability accelerates the break-off time of the jet from nozzle 700, and reduces the length of the ligament of the jet. This may be beneficial with high viscosity print fluids (e.g., 100 cP or more) or ultra-high viscosity print fluids (e.g., 1,000-10,000 cP or more). The difference in velocity may be exploited further for different objectives by using different firing modes to create the desired droplet shape. Larger or smaller droplet sizes may be created by means of adjusting the firing order of the wave-form. For example, a fill-before-fire favors a large inertial force over viscous forces, which in turn leads to an accelerated break-off of the jet. This is often characterized by the shortest ligament and fastest break-off time. It has the added benefit of creating fewer or no satellites. This leads to higher frequency jetting combined with less ill effects of the satellites or the creation of mist. The fire-before-fill is to be contrasted with fill-before-fire, which leads to smaller droplets and longer ligaments but within an acceptable range for jetting at these viscosities.

Figure 8:
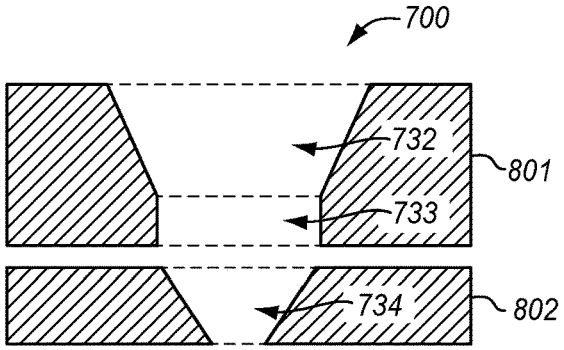
FIG. 8 is a cross-sectional view of a nozzle formed by two nozzle plates in an illustrative embodiment.
Figure 9:
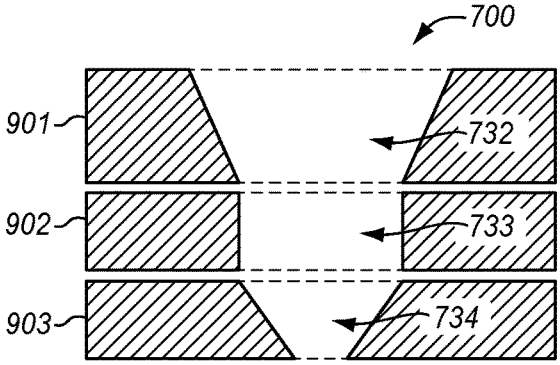
FIG. 9 is a cross-sectional view of a nozzle formed by three nozzle plates in an illustrative embodiment.

Nozzle 700 may be formed in a single nozzle plate 702 as shown in FIG. 7. Alternatively, a plurality of nozzle plates may be stacked together to form nozzle 700. FIG. 8 is a cross-sectional view of nozzle 700 formed by two nozzle plates in an illustrative embodiment. In this embodiment, nozzle 700 is formed with nozzle plates 801-802. Nozzle plate 801 defines or forms first converging section 732 and neck 733, while nozzle plate 802 defines or forms second converging section 734. FIG. 9 is a cross-sectional view of nozzle 700 formed by three nozzle plates in an illustrative embodiment. In this embodiment, nozzle 700 is formed with nozzle plates 901-903. Nozzle plate 901 defines or forms first converging section 732, nozzle plate 902 defines or forms neck 733, and nozzle plate 903 defines or forms second converging section 734. Nozzle 700 may be formed by more nozzle plates in other embodiments.

Figure 10:
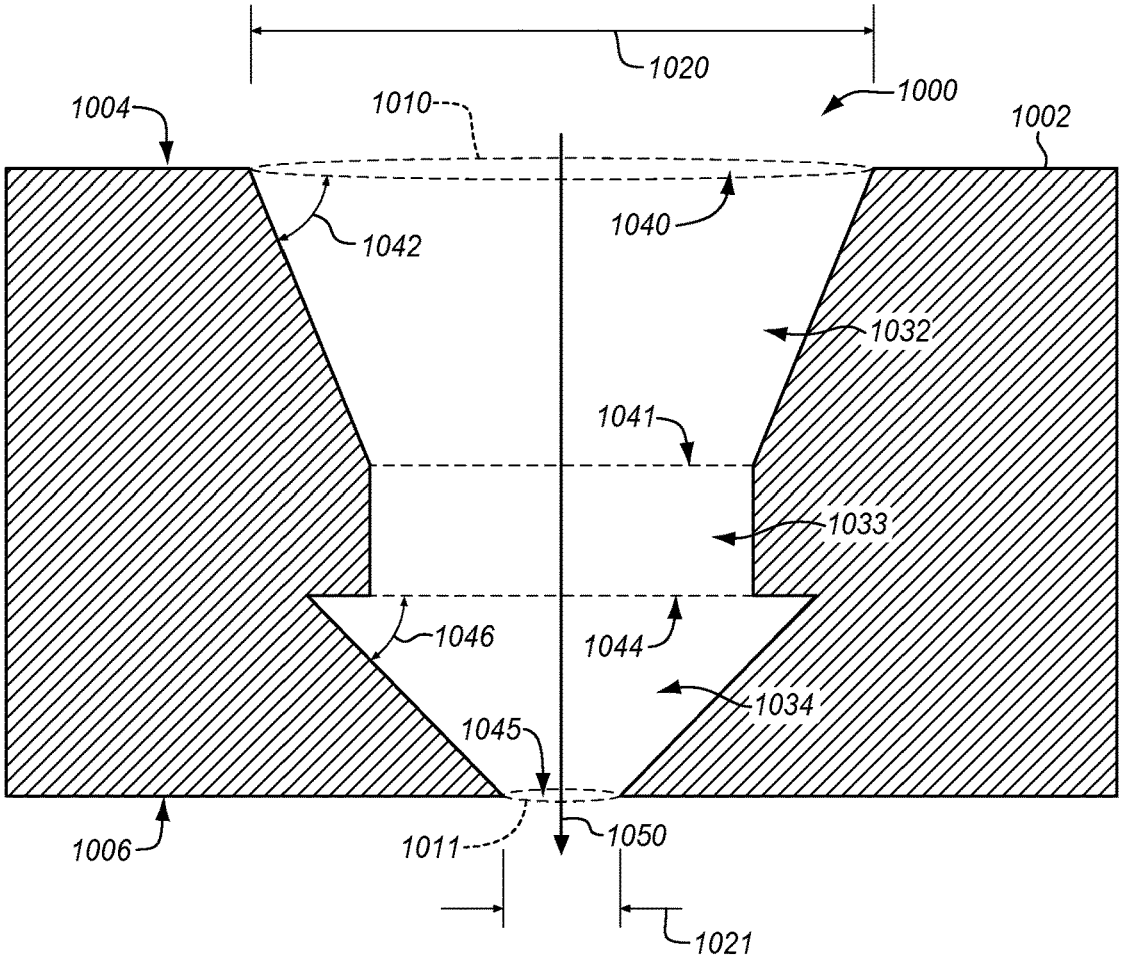
FIG. 10 is a cross-sectional view of a nozzle of a printhead in another illustrative embodiment.

FIG. 10 is a cross-sectional view of a nozzle 1000 of a printhead in another illustrative embodiment. Nozzle 1000 may be another example of a nozzle 380 described above for printhead 104. Nozzle 1000 comprises an aperture or opening through one or more nozzle plates 1002. Nozzle plate(s) 1002 in FIG. 10 may be an example of nozzle plate 325 shown in FIG. 3. Nozzle plate 1002 includes an interface surface 1004 and a discharge surface 1006. Interface surface 1004 represents a surface that abuts another plate in a plate stack, such as a lower restrictor plate 324 in FIG. 3. Discharge surface 1006 represents the surface from which a droplet of print fluid is ejected or jetted from a printhead. One end of nozzle 1000 is toward a higher-pressure region within a printhead (e.g., a pressure chamber), and is the entrance 1010 for a print fluid into nozzle 1000. The other end of nozzle 1000 is toward a lower-pressure region outside of the printhead (e.g., ambient air), and is the exit 1011 for the print fluid out of nozzle 1000. Entrance 1010 has a diameter 1020 that is larger than a diameter 1021 of exit 1011.

From entrance 1010 to exit 1011, nozzle 1000 includes a first converging section 1032, a neck 1033 that abuts or adjoins first converging section 1032, and a second converging section 1034 that abuts or adjoins neck 1033. First converging section 1032 has a cross-sectional area that decreases in the flow direction of print fluid through nozzle 1000, which is indicated by arrow 1050. First converging section 1032 has a cone shape that tapers or angles from end 1040 to end 1041 so that the diameter of first converging section 1032 decreases from end 1040 to end 1041. Neck 1033 has a cross-sectional area that is generally constant, uniform, or otherwise continuous in the flow direction of print fluid through nozzle 1000. The diameter of neck 1033 may correspond with the diameter of first converging section 1032 at end 1041, and remains uniform along a length of neck 1033 in the flow direction (e.g., arrow 1050). Second converging section 1034 has a cross-sectional area that decreases in the flow direction of print fluid through nozzle 1000. Second converging section 1034 has a cone shape that tapers or angles from end 1044 to end 1045 (i.e., exit 1011) so that the diameter of second converging section 1034 decreases from end 1044 to end 1045. In this embodiment, the diameter (or cross-sectional area) of second converging section 1034 at end 1044 is larger than the diameter (or cross-sectional area) of neck 1033. Thus, nozzle 1000 diverges in the region where neck 1033 transitions into second converging section 1034. The diameter 1021 of second converging section 1034 at end 1045 is less than the diameter of neck 1033 and first converging section 1032 at end 1041.

A head designer may adjust the convergence angle 1042 of first converging section 1032, the convergence angle 1046 of second converging section 1034, and/or the diameter of neck 1033 based on the desired jetting characteristics. In one embodiment, the convergence angles 1042/1046 may be the same or equivalent. In another embodiment, the convergence angle 1042 of first converging section 1032 may be greater than the convergence angle 1046 of second converging section 1034. In another embodiment, the convergence angle 1046 of second converging section 1034 may be greater than the convergence angle 1042 of first converging section 1032.

As a print fluid travels through first converging section 1032, the velocity of the print fluid increases due to the converging shape of first converging section 1032 (i.e., conservation of mass). As the print fluid travels through neck 1033, the velocity of the print fluid stays constant due to the uniform diameter of neck 1033. As a print fluid travels out of neck 1033 and into second converging section 1034, the velocity of the print fluid decreases due to the larger diameter of second converging section 1034. As the print fluid travels through second converging section 1034, the velocity of the print fluid again increases due to the converging shape of second converging section 1034. The difference in velocity of the print fluid in the different sections of nozzle 1000 affects the viscous forces of the print fluid in nozzle 1000, especially where the shape of nozzle 1000 sharply deviates from the uniform diameter of neck 1033 to the larger diameter of second converging section 1034. This creates an instability in the jet discharged from nozzle 1000, which accelerates the break-off time of the jet from nozzle 1000, and reduces the length of the ligament of the jet. The difference in velocity is helped in this case by the presence of a geometry that increases the inertial force by increasing the fluid mass available at the base of second converging section 1034. This design makes available an inertial mass that is faster to deploy into the jet from the layer closest to nozzle 1000.

Figure 11:
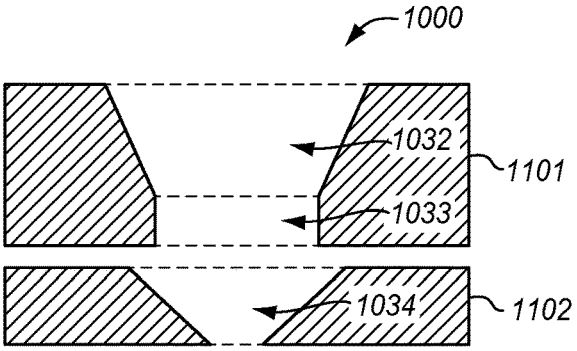
FIG. 11 is a cross-sectional view of a nozzle formed by two nozzle plates in an illustrative embodiment.
Figure 12:
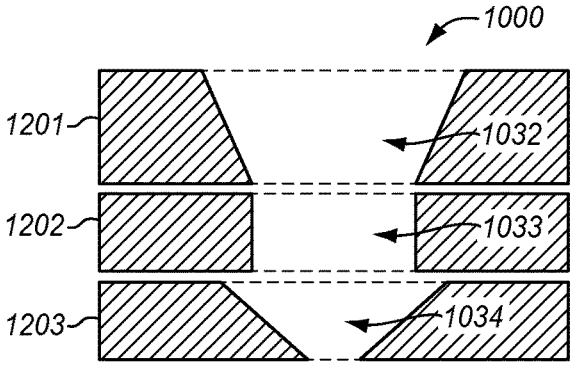
FIG. 12 is a cross-sectional view of a nozzle formed by three nozzle plates in an illustrative embodiment.

Nozzle 1000 may be formed in a single nozzle plate 1002 as shown in FIG. 10. Alternatively, a plurality of nozzle plates may be stacked together to form nozzle 1000. FIG. 11 is a cross-sectional view of nozzle 1000 formed by two nozzle plates in an illustrative embodiment. In this embodiment, nozzle 1000 is formed with nozzle plates 1101-1102. Nozzle plate 1101 defines or forms first converging section 1032 and neck 1033, while nozzle plate 1102 defines or forms second converging section 1034. FIG. 12 is a cross-sectional view of nozzle 1000 formed by three nozzle plates in an illustrative embodiment. In this embodiment, nozzle 1000 is formed with nozzle plates 1201-1203. Nozzle plate 1201 defines or forms first converging section 1032, nozzle plate 1202 defines or forms neck 1033, and nozzle plate 1203 defines or forms second converging section 1034. Nozzle 1000 may be formed by more nozzle plates in other embodiments.

Figure 13:
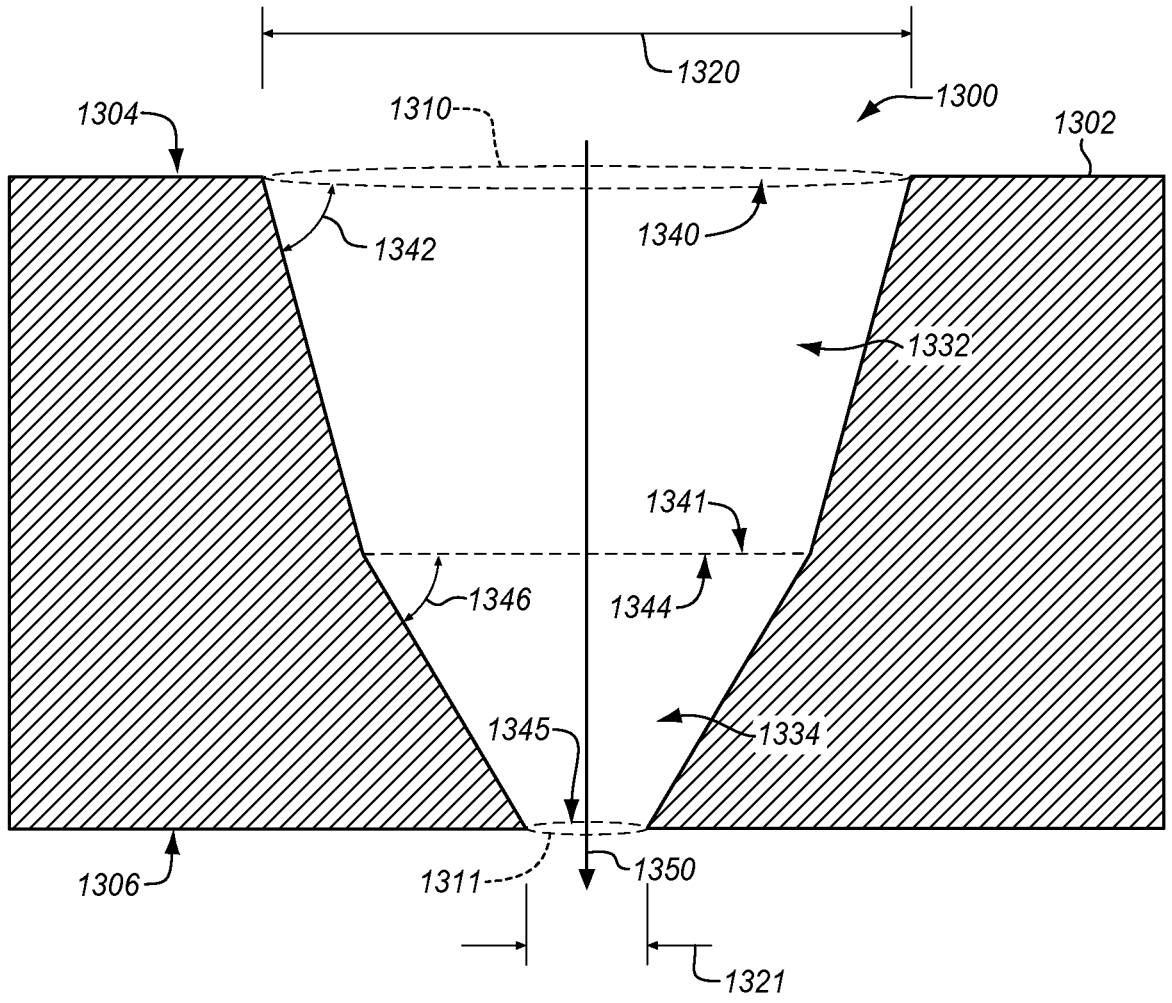
FIG. 13 is a cross-sectional view of a nozzle of a printhead in another illustrative embodiment.

FIG. 13 is a cross-sectional view of a nozzle 1300 of a printhead in an illustrative embodiment. Nozzle 1300 may be an example of a nozzle 380 described above for printhead 104. Nozzle 1300 comprises an aperture or opening through one or more nozzle plates 1302. Nozzle plate(s) 1302 in FIG. 13 may be an example of nozzle plate 325 shown in FIG. 3. Nozzle plate 1302 includes an interface surface 1304 and a discharge surface 1306. Interface surface 1304 represents a surface that abuts another plate in a plate stack, such as a lower restrictor plate 324 in FIG. 3. Discharge surface 1306 represents the surface from which a droplet of print fluid is ejected or jetted from a printhead. One end of nozzle 1300 is toward a higher-pressure region within a printhead (e.g., a pressure chamber), and is the entrance 1310 for a print fluid into nozzle 1300. The other end of nozzle 1300 is toward a lower-pressure region outside of the printhead (e.g., ambient air), and is the exit 1311 for the print fluid out of nozzle 1300. Exit 1311 may also be referred to as the orifice. Entrance 1310 has a diameter 1320 that is larger than a diameter 1321 of exit 1311.

From entrance 1310 to exit 1311 along its length, nozzle 1300 is comprised of a first converging section 1332, and a second converging section 1334 that abuts or adjoins first converging section 1332. First converging section 1332 has a cross-sectional area that decreases in the flow direction of print fluid through nozzle 1300, which is indicated by arrow 1350. First converging section 1332 has a cone shape that tapers or angles from end 1340 to end 1341 so that the diameter of first converging section 1332 decreases from end 1340 to end 1341. Second converging section 1334 has a cross-sectional area that decreases in the flow direction of print fluid through nozzle 1300. Second converging section 1334 has a cone shape that tapers or angles from end 1344 to end 1345 so that the diameter of second converging section 1334 decreases from end 1344 to end 1345 (i.e., exit 1311). In this embodiment, the diameter (or cross-sectional area) of second converging section 1334 at end 1344 is generally the same as or equivalent to the diameter (or cross-sectional area) of first converging section 1332 at end 1341. The diameter 1321 of second converging section 1334 at end 1345 is less than the diameter of first converging section 1332 at end 1341.

A head designer may adjust the convergence angle 1342 of first converging section 1332, and/or the convergence angle 1346 of second converging section 1334 based on the desired jetting characteristics. The convergence angles 1342/1346 are different to create velocity changes of the print fluid through nozzle 1300. In this embodiment, the convergence angle 1342 of first converging section 1332 is less than the convergence angle 1346 of second converging section 1334.

As a print fluid travels through first converging section 1332, the velocity of the print fluid increases due to the converging shape of first converging section 1332. As a print fluid travels through second converging section 1334, the velocity of the print fluid again increases due to the converging shape of second converging section 1334. The difference in velocity of the print fluid in the different sections of nozzle 1300 affects the viscous forces of the print fluid in nozzle 1300, and creates an instability in the jet discharged from nozzle 1300. This instability accelerates the break-off time of the jet from nozzle 1300, and reduces the length of the ligament of the jet.

Figure 14:
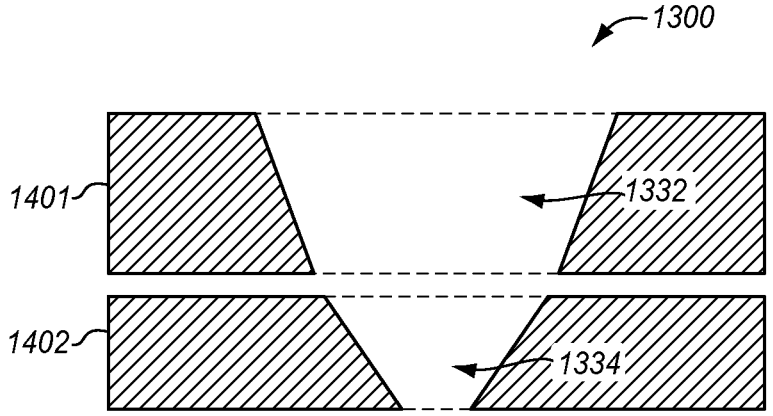
FIG. 14 is a cross-sectional view of a nozzle formed by two nozzle plates in an illustrative embodiment.

Nozzle 1300 may be formed in a single nozzle plate 1302 as shown in FIG. 13. Alternatively, a plurality of nozzle plates may be stacked together to form nozzle 1300. FIG. 14 is a cross-sectional view of nozzle 1300 formed by two nozzle plates in an illustrative embodiment. In this embodiment, nozzle 1300 is formed with nozzle plates 1401-1402. Nozzle plate 1401 defines or forms first converging section 1332, while nozzle plate 1402 defines or forms second converging section 1334. Nozzle 1300 may be formed by more nozzle plates in other embodiments.

Figure 15:
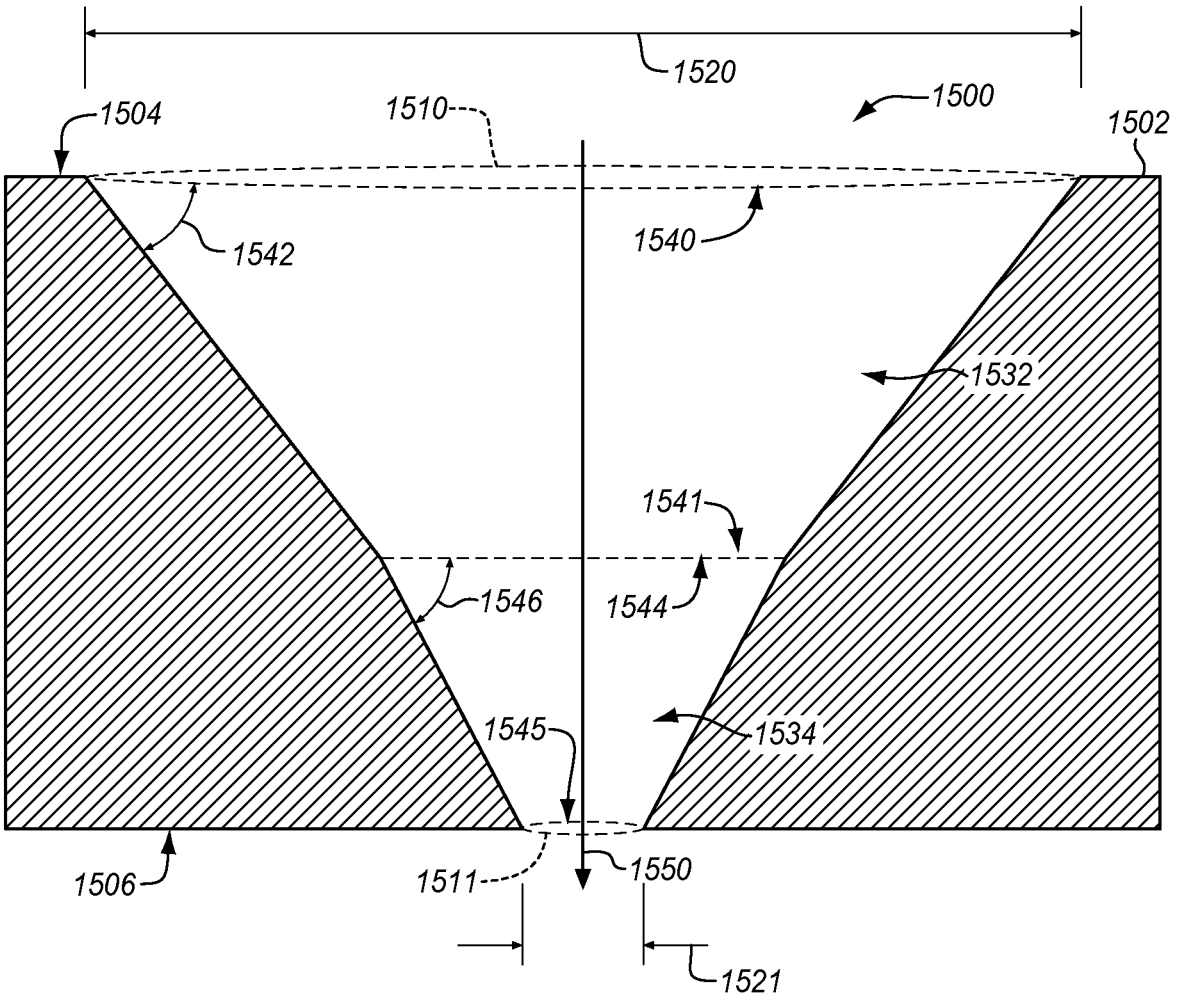
FIG. 15 is a cross-sectional view of a nozzle of a printhead in another illustrative embodiment.

FIG. 15 is a cross-sectional view of a nozzle 1500 of a printhead in an illustrative embodiment. Nozzle 1500 may be an example of a nozzle 380 described above for printhead 104. Nozzle 1500 comprises an aperture or opening through one or more nozzle plates 1502. Nozzle plate(s) 1502 in FIG. 15 may be an example of nozzle plate 325 shown in FIG. 3. Nozzle plate 1502 includes an interface surface 1504 and a discharge surface 1506. Interface surface 1504 represents a surface that abuts another plate in a plate stack, such as a lower restrictor plate 324 in FIG. 3. Discharge surface 1506 represents the surface from which a droplet of print fluid is ejected or jetted from a printhead. One end of nozzle 1500 is toward a higher-pressure region within a printhead (e.g., a pressure chamber), and is the entrance 1510 for a print fluid into nozzle 1500. The other end of nozzle 1500 is toward a lower-pressure region outside of the printhead (e.g., ambient air), and is the exit 1511 for the print fluid out of nozzle 1500. Exit 1511 may also be referred to as the orifice. Entrance 1510 has a diameter 1520 that is larger than a diameter 1521 of exit 1511.

From entrance 1510 to exit 1511 along its length, nozzle 1500 is comprised of a first converging section 1532, and a second converging section 1534 that abuts or adjoins first converging section 1532. First converging section 1532 has a cross-sectional area that decreases in the flow direction of print fluid through nozzle 1500, which is indicated by arrow 1550. First converging section 1532 has a cone shape that tapers or angles from end 1540 to end 1541 so that the diameter of first converging section 1532 decreases from end 1540 to end 1541. Second converging section 1534 has a cross-sectional area that decreases in the flow direction of print fluid through nozzle 1500. Second converging section 1534 has a cone shape that tapers or angles from end 1544 to end 1545 so that the diameter of second converging section 1534 decreases from end 1544 to end 1545 (i.e., exit 1511). In this embodiment, the diameter (or cross-sectional area) of second converging section 1534 at end 1544 is generally the same as or equivalent to the diameter (or cross-sectional area) of first converging section 1532 at end 1541. The diameter 1521 of second converging section 1534 at end 1545 is less than the diameter of first converging section 1532 at end 1541.

A head designer may adjust the convergence angle 1542 of first converging section 1532, and/or the convergence angle 1546 of second converging section 1534 based on the desired jetting characteristics. The convergence angles 1542/1546 are different to create velocity changes of the print fluid through nozzle 1500. In this embodiment, the convergence angle 1542 of first converging section 1532 is greater than the convergence angle 1546 of second converging section 1534.

As a print fluid travels through first converging section 1532, the velocity of the print fluid increases due to the converging shape of first converging section 1532. As a print fluid travels through second converging section 1534, the velocity of the print fluid again increases due to the converging shape of second converging section 1534. The difference in velocity of the print fluid in the different sections of nozzle 1500 affects the viscous forces of the print fluid in nozzle 1500, and creates an instability in the jet discharged from nozzle 1500. This instability accelerates the break-off time of the jet from nozzle 1500, and reduces the length of the ligament of the jet.

Figure 16:
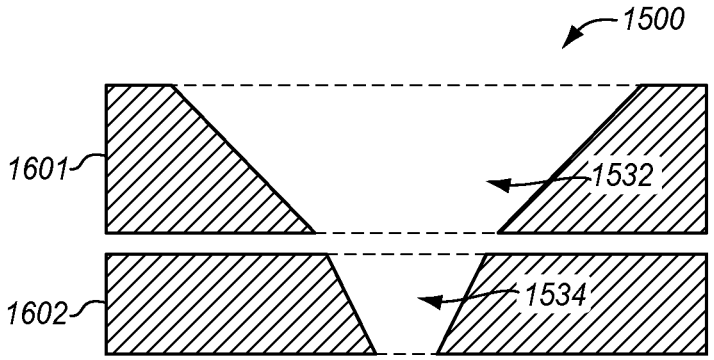
FIG. 16 is a cross-sectional view of a nozzle formed by two nozzle plates in an illustrative embodiment.

Nozzle 1500 may be formed in a single nozzle plate 1502 as shown in FIG. 15. Alternatively, a plurality of nozzle plates may be stacked together to form nozzle 1500. FIG. 16 is a cross-sectional view of nozzle 1500 formed by two nozzle plates in an illustrative embodiment. In this embodiment, nozzle 1500 is formed with nozzle plates 1601-1602. Nozzle plate 1601 defines or forms first converging section 1532, while nozzle plate 1602 defines or forms second converging section 1534. Nozzle 1500 may be formed by more nozzle plates in other embodiments.

Although specific embodiments were described herein, the scope of the invention is not limited to those specific embodiments. The scope of the invention is defined by the following claims and any equivalents thereof

What is claimed is:

1. A printhead comprising:

a plurality of nozzle plates stacked together to form nozzles configured to eject a print fluid;

wherein each nozzle of the nozzles comprises:

a first converging section having a cross-sectional area that decreases in a flow direction of the print fluid through the nozzle;

a neck adjoining the first converging section, and having a cross-sectional area that is uniform in the flow direction of the print fluid through the nozzle; and a second converging section adjoining the neck, and having a cross-sectional area that decreases in the flow direction of the print fluid through the nozzle.

2. The printhead of claim 1 wherein:

the plurality of nozzle plates is comprised of a first nozzle plate and a second nozzle plate stacked together to form the nozzles;

the first nozzle plate defines the first converging section; and the second nozzle plate defines the second converging section.

3. The printhead of claim 1 wherein:

the plurality of nozzle plates is comprised of a first nozzle plate, a second nozzle plate, and a third nozzle plate stacked together to form the nozzles;

the first nozzle plate defines the first converging section;

the second nozzle plate defines the neck; and the third nozzle plate defines the second converging section.

4. The printhead of claim 1 wherein:

the first converging section and the second converging section are cone-shaped.

5. The printhead of claim 1 wherein:

an orifice of the nozzle where the print fluid exits out of the nozzle is circular.

6. The printhead of claim 1 wherein:

a first convergence angle of the first converging section is equivalent to a second convergence angle of the second converging section.

7. The printhead of claim 1 wherein:

a first convergence angle of the first converging section is greater than a second convergence angle of the second converging section.

8. The printhead of claim 1 wherein:

a first convergence angle of the first converging section is less than a second convergence angle of the second converging section.

9. A jetting apparatus comprising:

the printhead of claim 1.

10. A printhead comprising:

a housing and a plate stack attached to the housing;

wherein the plate stack includes a plurality of nozzle plates that form nozzles of the printhead that eject a print fluid;

wherein each nozzle of the nozzles comprises a first converging section, a neck, and a second converging section defined by the plurality of nozzle plates;

wherein the first converging section has a diameter that decreases in a flow direction of the print fluid through the nozzle from a first end that defines an entrance of the print fluid into the nozzle, to a second end;

wherein the neck adjoins the second end of the first converging section, and has a diameter that is uniform in the flow direction; and wherein the second converging section has a diameter that decreases in the flow direction from a third end that adjoins the neck, to a fourth end that defines an orifice where the print fluid exits the nozzle.

11. The printhead of claim 10 wherein:

the plurality of nozzle plates is comprised of a first nozzle plate and a second nozzle plate stacked together to form the nozzles;

the first nozzle plate defines the first converging section; and the second nozzle plate defines the second converging section.

12. The printhead of claim 10 wherein:

the plurality of nozzle plates is comprised of a first nozzle plate, a second nozzle plate, and a third nozzle plate stacked together to form the nozzles;

the first nozzle plate defines the first converging section;

the second nozzle plate defines the neck; and the third nozzle plate defines the second converging section.

13. The printhead of claim 10 wherein:

the orifice of the nozzle is circular.

14. A jetting apparatus comprising:

the printhead of claim 10.

15. A printhead comprising:

a plurality of nozzles configured to eject a print fluid;

wherein each nozzle of the plurality comprises:

an entrance for the print fluid into the nozzle, an exit for the print fluid out of the nozzle, and a first converging section and a second converging section between the entrance and the exit;

from the entrance to the exit along a length of the nozzle in a flow direction of the print fluid through the nozzle:

a diameter of the nozzle decreases in the first converging section at a first convergence angle;

a diameter of the nozzle decreases in the second converging section that adjoins the first converging section at a second convergence angle that is different than the first convergence angle; and a diameter of the second converging section is the same as a diameter of the first converging section where the second converging section adjoins the first converging section;

wherein the first converging section and the second converging section are cone-shaped.

16. The printhead of claim 15 wherein:

the first convergence angle of the first converging section is greater than the second convergence angle of the second converging section.

17. The printhead of claim 15 wherein:

the first convergence angle of the first converging section is less than the second convergence angle of the second converging section.

18. The printhead of claim 15 further comprising:

a first nozzle plate and a second nozzle plate stacked together to form the nozzles;

wherein the first nozzle plate defines the first converging section of the nozzle; and wherein the second nozzle plate defines the second converging section of the nozzle.

19. The printhead of claim 15 wherein:

an orifice of the nozzle where the print fluid exits out of the nozzle is circular.

20. A jetting apparatus comprising:

the printhead of claim 15.

* * * * *